US008913467B2

(12) United States Patent
Claret et al.

(10) Patent No.: US 8,913,467 B2
(45) Date of Patent: Dec. 16, 2014

(54) TIMEPIECE WITH MECHANICAL CARDS

(75) Inventors: Christophe Claret, Chez-le-Bart (CH); Jan Dubois, La Chaux-de-Fonds (CH); Alain Schiesser, Colombier (CH)

(73) Assignee: Christophe Claret S.A., Le Locle (CH)

( * ) Notice: Subject to any disclaimer, the term of this patent is extended or adjusted under 35 U.S.C. 154(b) by 0 days.

(21) Appl. No.: 14/003,918

(22) PCT Filed: Mar. 7, 2012

(86) PCT No.: PCT/EP2012/053897
§ 371 (c)(1),
(2), (4) Date: Sep. 27, 2013

(87) PCT Pub. No.: WO2012/123306
PCT Pub. Date: Sep. 20, 2012

(65) Prior Publication Data

US 2014/0016445 A1 Jan. 16, 2014

(30) Foreign Application Priority Data

Mar. 14, 2011 (CH) ..... 427/11

(51) Int. Cl.
*G04B 47/04* (2006.01)
*G04B 19/06* (2006.01)

(52) U.S. Cl.
CPC ..... *G04B 47/044* (2013.01); *G04B 47/04* (2013.01); *G04B 19/06* (2013.01)
USPC ..... 368/77; 368/233; 368/3; 368/10; 368/223; 273/293

(58) Field of Classification Search
USPC ..... 368/77, 233, 223, 3, 10; 273/293
See application file for complete search history.

(56) References Cited

U.S. PATENT DOCUMENTS

| | | | | |
|---|---|---|---|---|
| 2,180,908 | A * | 11/1939 | Nevinger | 340/309.4 |
| 2,287,679 | A * | 6/1942 | Greenawalt | 368/77 |
| 6,009,048 | A * | 12/1999 | Raesz | 368/10 |
| 7,420,885 | B2 * | 9/2008 | Claret et al. | 368/265 |
| 7,724,611 | B2 * | 5/2010 | Groothuis et al. | 368/37 |
| 2003/0035346 | A1 * | 2/2003 | Laughlin | 368/250 |
| 2004/0013042 | A1 * | 1/2004 | Farine | 368/10 |
| 2004/0036218 | A1 * | 2/2004 | Inoue | 273/292 |
| 2005/0259519 | A1 * | 11/2005 | Muller | 368/80 |
| 2008/0239884 | A1 | 10/2008 | Muraji | |
| 2012/0113762 | A1 * | 5/2012 | Frost | 368/10 |

FOREIGN PATENT DOCUMENTS

| | | | |
|---|---|---|---|
| DE | 298 04 097 | U1 | 7/1998 |
| WO | 2007/069028 | A2 | 6/2007 |

OTHER PUBLICATIONS

International Search Report, dated Sep. 5, 2012, from corresponding PCT application.

* cited by examiner

*Primary Examiner* — Amy Cohen Johnson
*Assistant Examiner* — Matthew Powell
(74) *Attorney, Agent, or Firm* — Young & Thompson

(57) ABSTRACT

A timepiece is equipped with a novel type of entertainment, that is a mechanical card game. The timepiece includes: a dial (10) provided with a plurality of windows (12); systems (14) for opening and closing at least some of the windows (12), actuated by control bodies; a plurality of display disks (16) carrying representations of cards to be played, to be visible via the windows (12), the disks being pivoted on axes that are perpendicular to the plane of the dial (10); and a system (18) for rotating the disks and stopping them at random.

20 Claims, 7 Drawing Sheets

TIMEPIECE WITH MECHANICAL CARDS

TECHNICAL FIELD

The present invention relates to the field of mechanical horology. It more particularly relates to a timepiece with a complication offering entertainment to a user.

BACKGROUND OF THE INVENTION

A priori, the primary function of timepieces is to provide time-related information. Traditional horology mechanisms have been used to offer more recreational mechanical systems, such as machines or music boxes.

Furthermore, certain watches of the state of the art include, in addition to the typical mechanisms making it possible to display time information, complications allowing a user to have a game on his watch. One remarkable embodiment, known under the name Vintage 1945 Jackpot Tourbillon, is, in addition to a higher horology timepiece, a masterpiece in miniaturization, including a slot machine game. The mechanism is activated by pulling a lever on the right side of the case. A rack then rises along the movement to actuate three rollers, each of which bears five symbols: spade, heart, diamond, horseshoe and bell. When the rack is lowered again, it activates the stoppers that stop the rollers one by one and simultaneously sounds a striking-work. Of the 125 possible combinations, only the three aligned bells represent the jackpot.

The present invention aims to propose a new entertaining timepiece.

BRIEF DESCRIPTION OF THE INVENTION

More specifically, the invention relates to a timepiece equipped with a set of mechanical cards. To produce such a game, the timepiece comprises:

- a dial provided with a plurality of apertures,
- systems for opening and closing at least some of said apertures actuated by control organs,
- a plurality of display discs bearing depictions of playing cards, to be visible through said apertures, the discs being pivoted on axes perpendicular to the plane of the dial, and
- a system for rotating and randomly stopping the discs.

In one particular embodiment of the invention, the illustrated card game is a blackjack game. The dial is pierced with three apertures for the bank, distributed in a first area of the dial, and four apertures for the player, distributed in another area of the dial. For the bank and the player, two of the apertures are closed upon dealing the cards and may be opened on command, by respectively actuating first and second command push-pieces.

BRIEF DESCRIPTION OF THE DRAWINGS

Other details of the invention will appear more clearly upon reading the following description, done in reference to the appended drawing, in which.

DETAILED DESCRIPTION OF THE INVENTION

Figure 1:
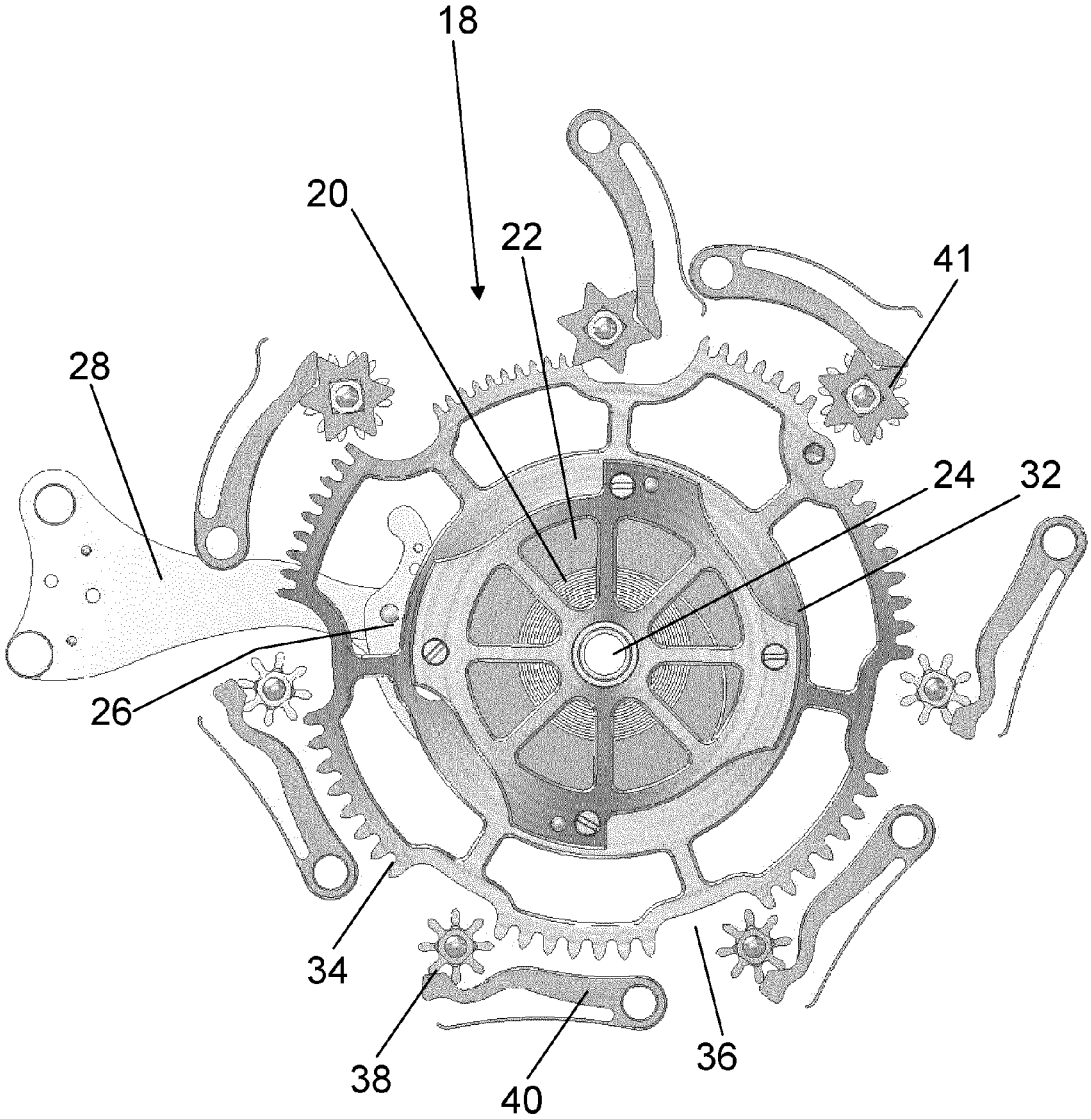
FIGS. 1 and 2 are illustrations of the mechanism according to a first embodiment of the invention.
Figure 2:
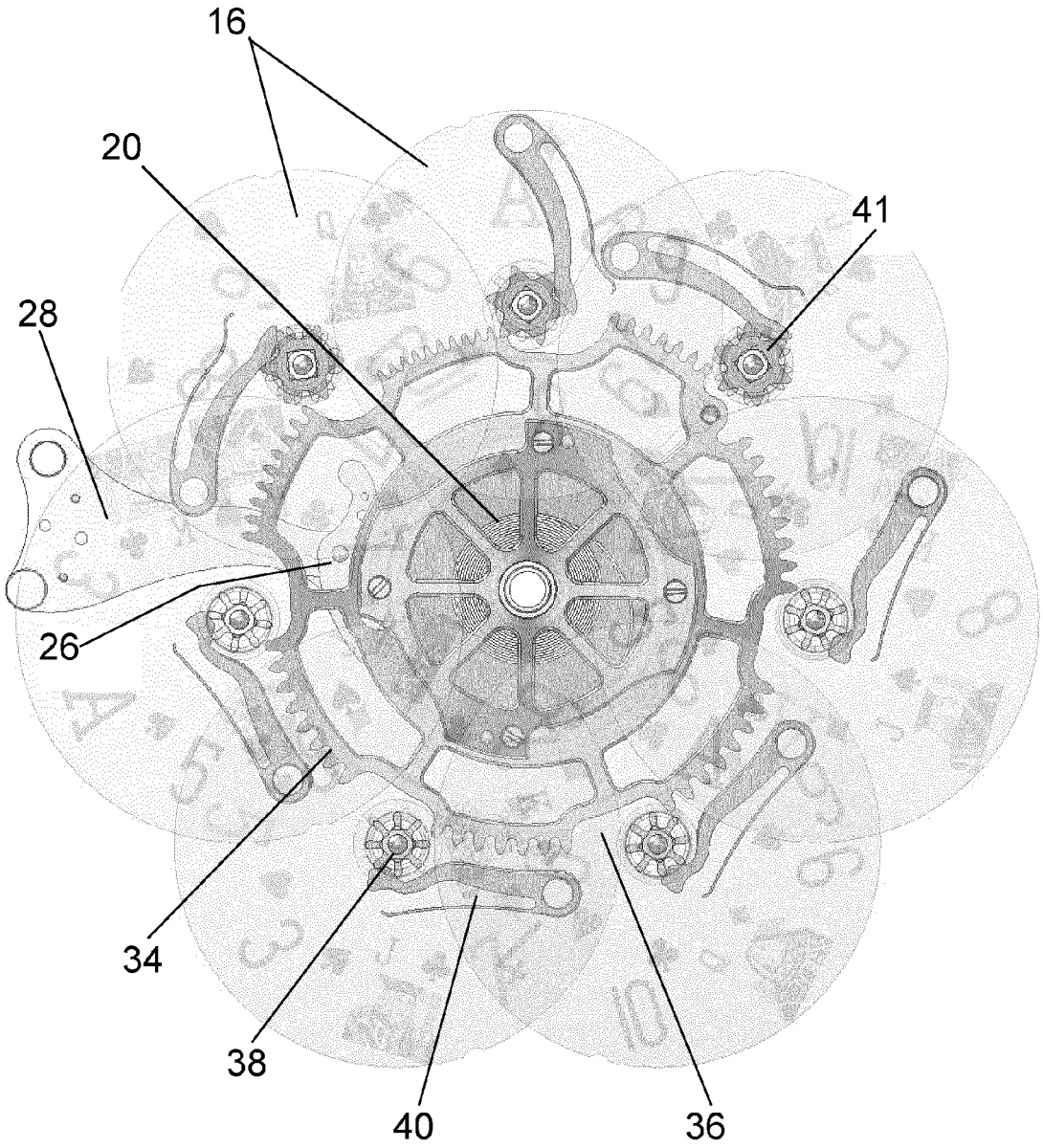
Figure 3:
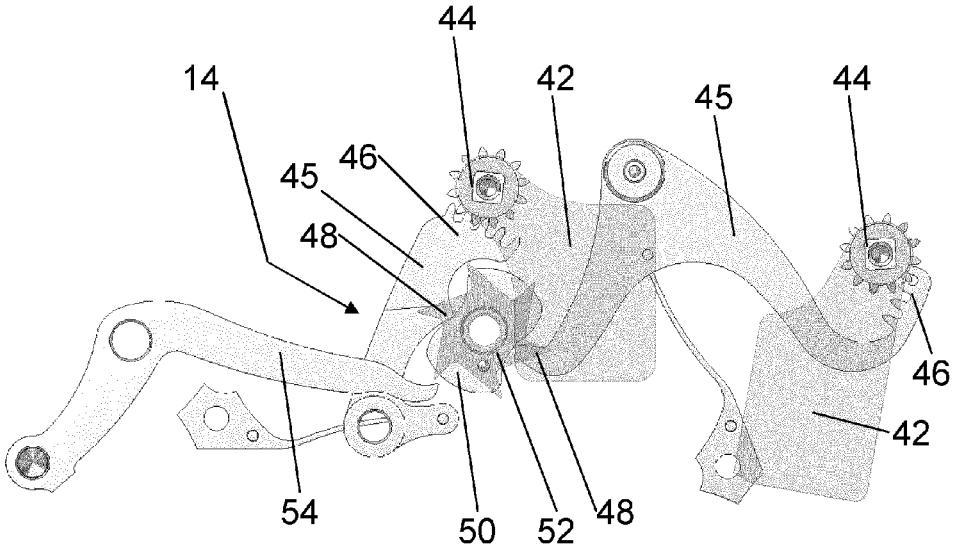
FIG. 3 shows an enlarged view of part of the mechanism.

The timepiece according to the invention is equipped with a mechanical card game. As will be understood hereafter, this card game is independent of the time base and the clockwork movement to which it may be attached. This movement may provide time information and display it using hands or other conventional organs and will not be described in this description. Advantageously but non-limitingly, the card game mechanism according to the invention is arranged in a modular manner on the basic movement. In such a configuration, the different elements of the mechanism are mounted on the housing of the module.

To allow only the cards dealt during the game to be visible, the timepiece according to the invention comprises a dial 11 provided with a plurality of apertures 12. The following description relates to one particular embodiment illustrated in the drawing, in which the card game produced is a blackjack game. In this game, after the cards have been dealt, the player and the bank choose to expose cards (i.e., in a real game, to turn them over) to reach 21 points by adding the value of each visible card. To reproduce this particularly of the game, the apertures 12 may be closed or left open, using opening and closing systems 14 actuated by control organs. In the blackjack game, only some of the apertures 12 are provided with an opening and closing system 14, others being left permanently open.

The depictions of the cards are arranged on a plurality of display discs 16. The discs are positioned matching the apertures 12, such that the depictions of one disc are visible through one of the apertures 12, when that aperture is open. The discs are pivoted on axes perpendicular to the plane of the dial 10.

The timepiece according to the invention further includes a system 18 for rotating and randomly stopping the discs, allowing the display discs 16 to stop in random positions. One thus obtains random card distributions, which makes it possible to renew the draws.

Figure 4:
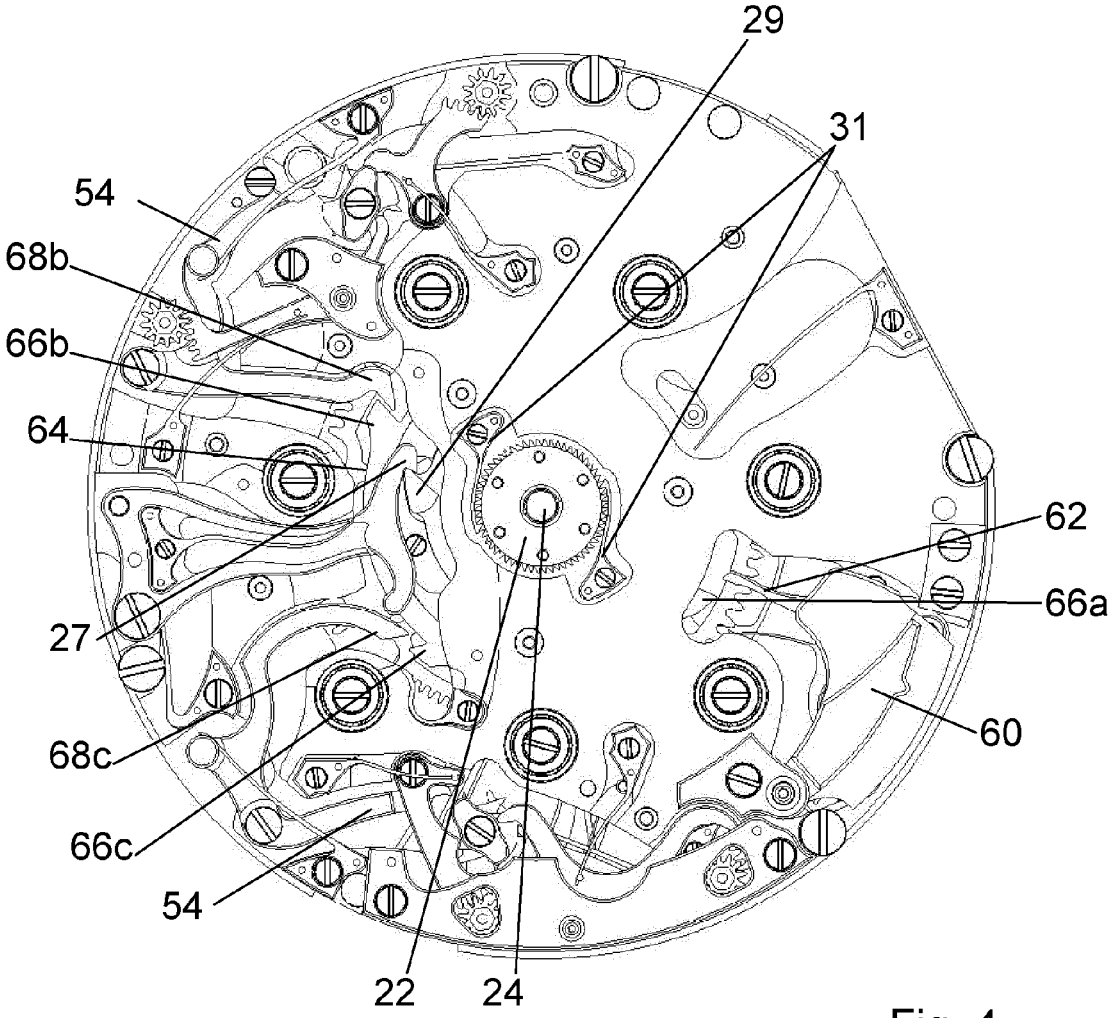
FIG. 4 shows the bottom side of the mechanism according to the invention.
Figure 5:
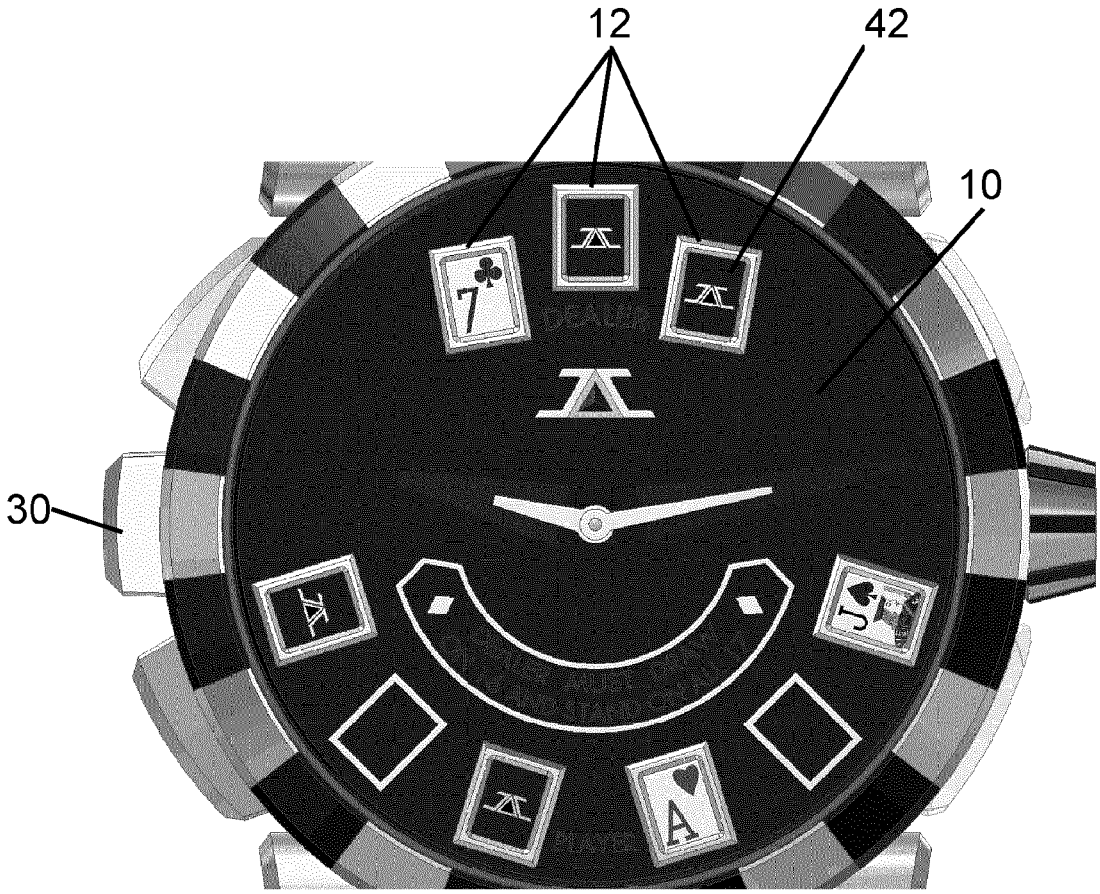
FIG. 5 shows a timepiece according to a first embodiment of the invention.

According to the illustrated embodiment, the system 18 for rotating and randomly stopping the discs comprises a spring organ, advantageously but non-limitingly assuming the form of a balance-spring 20, mounted in a drum 22, pivoting around an arbor 24, like a barrel. The balance-spring 20 is thus fixed, at a first end, on the arbor 24 around which the transmission plate 32 pivots, and, at a second end, on the drum 22. This spring organ may be wound by a winding click 26, provided with a beak 27 capable of cooperating with a blom stud 29 protruding on the drum 22. The barrel includes two clicks 31, shown in FIG. 4, acting on the arbor 24 so as to adjust the pre-winding of the spring 20. However, the barrel is not provided for long-term storage by the spring of energy beyond the pre-winding energy. Thus, when the spring 20 is wound, it lets down once the winding click 26 no longer holds the drum and supplies all of the energy stored during winding.

The winding click 26 is preferably actuated manually. It is pivotably mounted on a lever 28, actuated by a winding push-piece 30. When a user actuates that push-piece, he winds the spring organ by driving the drum in one direction.

After having performed a determined travel, the beak 27 unclicks and the winding click 26 leaves the spring 20. The energy supplied by the pressure from the push-piece is released abruptly by returning the drum in the other direction. An idle position is advantageously defined by a banking.

The timepiece further comprises a transmission plate 32 secured to the drum to receive the energy transmitted by the spring organ when the latter is released. Other methods of fixing the spring may be considered, by fixing the second end on a pin secured to the transmission plate, or by fixing the spring directly on the transmission plate.

The transmission plate 32 comprises a series of toothed sectors 34 interrupted by non-toothed sectors 36. The toothed sectors 34 and the non-toothed sectors 36 are positioned so as respectively to be engaged or not engaged with wheels 38 secured and coaxial to the display discs 16, in a synchronized manner. Thus, the transmission plate 32 is kinematically connected with the display discs 16 sequentially. More concretely, the toothed sectors 34 of the transmission plate 32 each attack a wheel 38, in a synchronized manner. Likewise, the toothed sectors 34 leave contact with those wheels 38 in a synchronized manner. The gear ratios between the wheels and the toothed sectors 34 are optimized to yield a speed of rotation adapted to the discs, favoring the renewal of the draws. When the drum is in the idle position, the non-toothed sectors 36 are across from the wheels 38, leaving the rotation of the wheels 38 and the display discs 16 free.

Thus, when the spring organ is wound, the toothed sectors engage with the wheels 38 and slowly drive them in a first direction. Then, when the spring organ is released after being wound, the toothed sectors engage with the wheels 38 and rotate the discs in the other direction, with all of the force transmitted by the spring organ. When the drum is returned to its idle position, the display discs 16 can rotate freely, under the effect of their inertia, aside from the friction of a jumper 40 arranged to stop the discs. Aside from the friction it generates, the jumper 40 also defines the stopped position of the discs 16, such that the depictions of cards are well positioned across from the aperture 12. Depending on the number of depictions of cards appearing on the disc, the jumper 40 acts on a star 41 secured to the disc or directly on the wheel 38.

In the example of blackjack, three display discs 16 each including 6 card depictions, visible behind three apertures 12 grouped together in an area of the dial 10, define the bank's hands. Four display discs 16 each including 8 depictions of cards, visible behind four apertures 12 distributed in another area of the dial 10, define the player's hands. The different springs of the jumpers 40 having different behaviors, the discs are braked differently, which makes it possible to vary the combinations, the total number of possible alternatives of which is 884,736, which guarantees that the game remains interesting. In practice, the bank may have 216 hand combinations and the player may have 4,096.

We will now describe the systems 14 for opening and closing the apertures 12.

The systems each include a covering flap 42 pivotably mounted below the dial 10 and capable of moving between a first position in which it closes the aperture 12 and a second position in which it leaves the aperture 12 open. Each covering flap 42 is mounted secured to a pinion 44, with which a positioning device meshes.

In the proposed example, the positioning device comprises a lever 45 provided with a rack 46 engaged with the pinion 44 mounted secured to a covering flap 42 and a feeler-spindle 48 kept bearing against a cam 50, the positions of which are indexed using a jumper (not shown).

To go from one indexed position to another, the cam 50 is mounted coaxially with a driving star 52, with which the control organ cooperates. Advantageously, the control organ is a push-piece arranged to actuate a lever 54 whereof the end can cooperate with the driving star 52 to pivot it.

After the cards are dealt, both the bank and the player have two apertures 12 that are closed, the other apertures 12 remaining open. Thus, the cam 50 is arranged so as to perform the following chronological actions, from an initial position in which the two apertures 12 that may be closed are covered:

- a first actuation of the control organ drives the pivoting of the first covering flap 42 and the opening of a first aperture 12,
- a second actuation of the control organ drives the pivoting of the second covering flap 42 and the opening of a second aperture 12, and
- a third actuation of the control organ drives the pivoting of the first and second covering flaps 42 and the closing of the first and second apertures 12.

It is possible to provide an automatic closing system by which, in case of pressure on the winding push-piece, a positioning hammer actuates a heart-piece situated on the cam and automatically drives the closing of the flaps while positioning the cam.

Thus proposed is a blackjack mechanism in which pressing on a winding push-piece 30 makes it possible to "deal" a new hand, for a new game. The bank and the player then have one and two cards visible, respectively. Using two other push-pieces acting as control organs of the systems 14 for opening and closing the flaps, the player can expose his cards by actuating one push-piece and the bank's cards by actuating the other push-piece, based on the progression of the game.

Based on the mechanism described above, it is possible to consider developing other card games involving successive deals and turning over of cards.

Figure 6A:
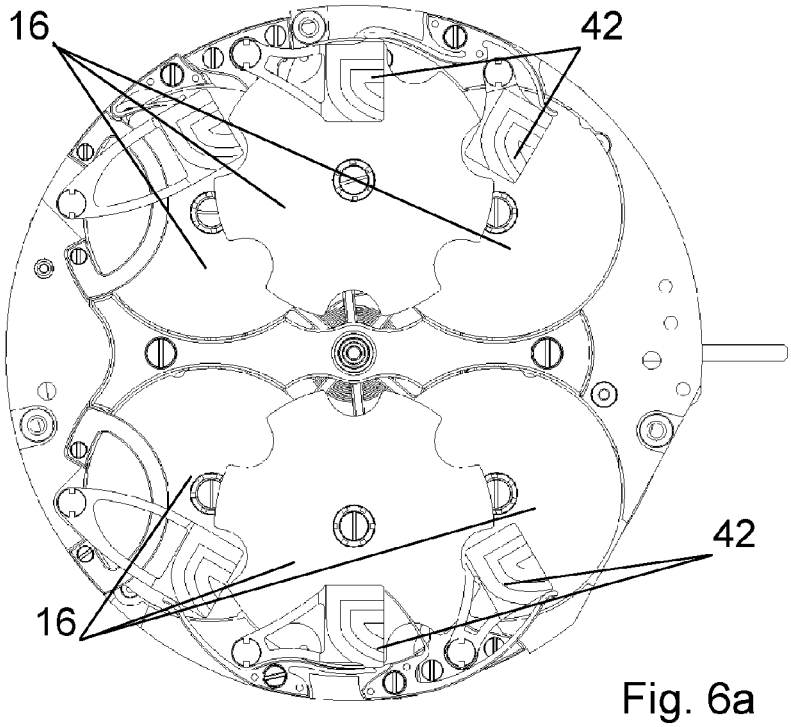
FIGS. 6*a*, 6*b* and 7 show alternatives of the invention.
Figure 6B:
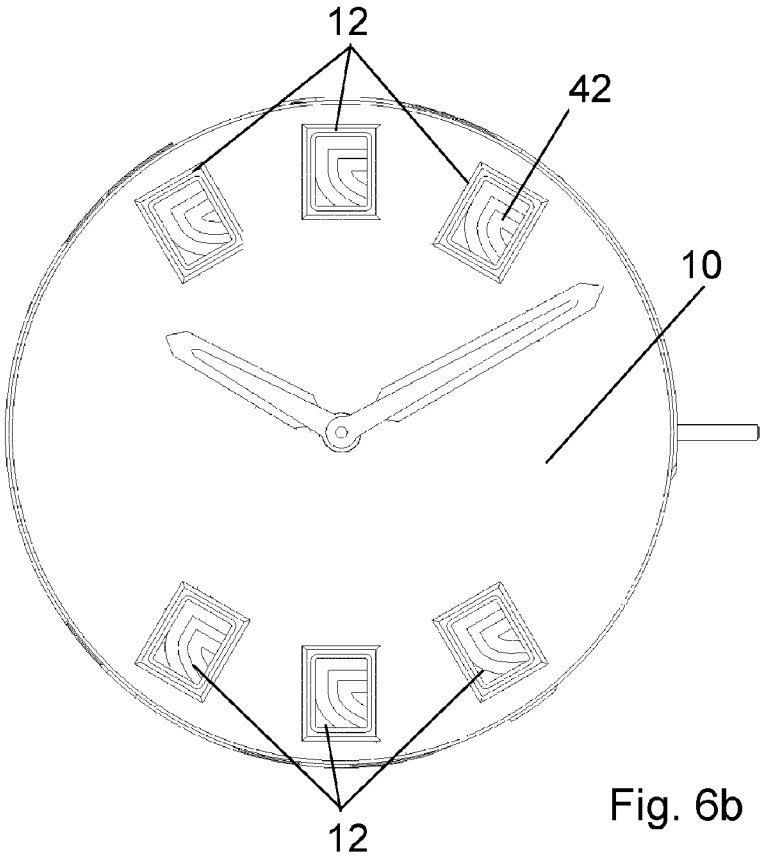

For example, it is also possible to produce a baccarat game, as proposed in FIGS. 6*a* and 6*b*. The player and the bank each have cards distributed on three discs, each disc being partially visible through an aperture 12 covered by an opening and closing system 14, comprising a moving flap. The discs of the flaps are actuated in the same way as described above relative to the blackjack game. It may be noted that in the blackjack and baccarat alternatives, the apertures are positioned concentrically to the movement.

In the progression of the baccarat game, after having shuffled the cards using a system 18 for rotating and randomly stopping the discs, similar to that described above, the moving flaps of two cards belonging to the player and the bank are opened, respectively using a first control organ associated with the player's three apertures and a second control organ associated with the bank's three apertures. Based on the cards exposed and the standard rules of the game, the third card of the player and the bank may or may not be exposed. The values of the cards are added according to the rules to determine the winner.

Figure 7:
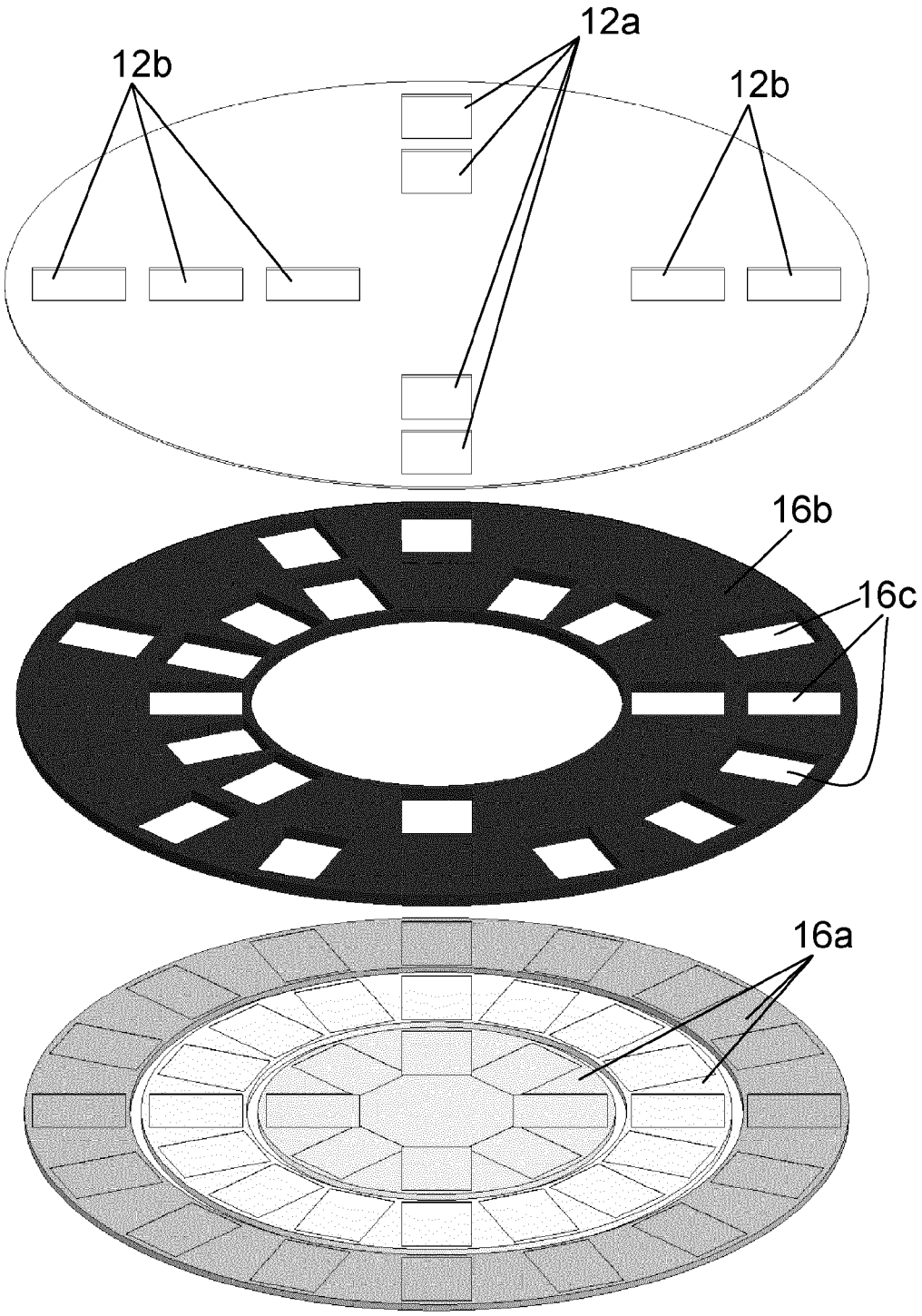

In an additional alternative proposed in FIG. 7, a poker game can be produced, in the example a game called "Texas hold'em". To preserve the interest of the progression of hands, the cards must be dealt accurately and have exactly the 52 cards of a complete deck, which may be distributed in the different areas of the game, i.e., to each of the players or and the central part of the game (connected to the dealer) that includes the cards turned over later (flop, turn and river).

To do this and unlike in the previous examples, the cards are positioned on coaxial discs, allowing the cards of the same disc to appear in the different playing areas. The cards appear at apertures that are advantageously arranged radially. Apertures 12*a* are provided for the players or apertures 12*b* are provided for the cards later turned over. Each player is associated with two apertures 12*a* positioned in an area of the dial. The example proposes two players, but there may be more. These apertures may not be covered by moving flaps but, to prevent the cards from being visible by the other players, a hiding system will be provided. For example, leafs (not shown), oriented obliquely, typically at 45°, and positioned through the aperture, make it possible to leave the discs visible only to the player situated facing the leafs.

The apertures 12*b* for the flop, turn and river are associated with an opening and closing system, each with a covering flap (not shown), which can be actuated by a control organ. Based on the above description, one skilled in the art will not have any difficulty in providing the cam and lever systems to turn over all 3 cards of the flop then, separately, the turn and the river.

To improve the interest of the progression of hands and increase the number of possible card combinations, and to prevent players from guessing other players' hands from their own hand, some of the cards are positioned on three coaxial and advantageously coplanar display discs 16*a* and the rest of the cards are positioned on an additional display disc 16*b*, overlapping at least one of the three so-called lower discs. In the example, the additional display disc overlaps the two lower discs with a larger diameter. The display discs can cover the entire movement and be concentric thereto to allow the passage of hands at the center of the discs. However, other arrangements are also possible. The 52 cards are distributed between the three display discs 16*a* and the additional disc 16*b*. The additional disc 16*b* also includes openings 16*c* through which the lower discs are visible. Thus, depending on the position of the additional display disc 16*b*, appearing in the apertures 12*a* and 12*b* are either cards from the additional display disc 16*b* or cards from the lower discs 16*a*, visible through openings of the additional display disc.

It will be noted that, in the proposed example, the lower display discs 16*b* bear 16 cards for the two display discs with a larger diameter and 8 cards for the disc with a smaller diameter. The additional disc bears 12 cards and 20 openings, positioned on two rings superimposed on the two lower display discs with a larger diameter. The two rings of the additional disc and the two lower display discs with a larger diameter therefore each include 16 angular portions, each receiving a card or an opening. This configuration makes it possible to obtain 32,768 different draws, making the progression of the game truly random.

As was proposed above, each disc is associated with a drive pinion, which can be sequentially connected to a transmission plate moved by a spring organ. As mentioned above, it is possible to provide jumpers acting on the pinions to brake and position them. The pinions and the jumpers define an indexing system ensuring that the cards of the lower discs indeed appear across from the openings of the additional disc 16*b*, which is also possible due to the fact that the two lower display discs with a larger diameter and the additional display disc have angular portions with the same dimensions.

This configuration offers cards of an agreeable size and a realistic and varied game, not allowing the player to guess the other players' hands.

It is also possible to provide a striking mechanism coupled to the game mechanism proposed above, making it possible to trigger a bell, for example upon opening or closing a covering flap 42. To that end, the striking mechanism includes a gong and a hammer 60 actuated by a lift 62 and positioned to strike the gong while emitting a sound. The lift 62 is kinematically connected to the control organs of the systems 14 for opening and closing the apertures 12. For example and advantageously, a ring 64 is rotatably mounted at the center of the game mechanism. It includes three teeth 66*a*, 66*b* and 66*c*. A first one 66*a* is designed to cooperate with the lift 62 and the other two 66*b* and 66*c* are designed to be pushed, respectively, by first 68*b* and second 68*c* fingers, connected to the levers 54 of each of the opening and closing systems. It will thus be understood that, when one of the levers 54 is actuated, the ring 64 is pivoted and drives the actuation of the hammer 60 by the tooth 66*a* and the emission of a sound. Similarly, a striking may be produced during actuation of the winding push-piece 30.

One skilled in the art may consider other alternatives, without going beyond the scope of the invention as defined by the claims.

The invention claimed is:

1. A timepiece wherein said timepiece is equipped with a set of mechanical cards for a card game, and comprises:

a dial provided with a plurality of apertures, opening and closing systems for opening and closing at least some of said apertures actuated by control organs, a plurality of display discs bearing depictions of playing cards, to be visible through said apertures, the discs being pivoted on axes perpendicular to the plane of the dial, and a system for rotating and randomly stopping the discs.

2. The timepiece according to claim 1, wherein said opening and closing systems each include a covering flap pivotably mounted below the dial and able to evolve between a first position in which it closes the aperture and a second position in which it leaves the aperture open.

3. The timepiece according to claim 2, wherein said covering flaps are mounted to a pinion, with which a positioning device meshes.

4. The timepiece according to claim 3, wherein said positioning device comprises a lever provided with a rack engaged with said pinion and a feeler-spindle kept bearing against a cam whose positions are indexed.

5. The timepiece according to claim 4, wherein the cam is mounted coaxial with a driving star, with which the control organ cooperates to pivot the cam from one indexed position to another.

6. The timepiece according to claim 1, wherein the card game is a blackjack game and said timepiece comprises:

three display discs visible behind three apertures distributed in a first area of the dial, defining a bank's hands, two of the apertures being able to be closed using a first opening and closing system actuated by a first control organ, and four display discs visible behind four apertures distributed in another area of the dial, defining a player's hands, two of the apertures being able to be closed using two opening and closing systems actuated by a second control organ.

7. The timepiece according to claim 6, wherein the opening and closing systems each include a covering flap pivotably mounted below the dial and able to evolve between a first position in which it closes the aperture and a second position in which it leaves the aperture open, and are arranged so as to chronologically perform the following actions, from an initial position in which the two apertures that can be closed are covered:

a first actuation of the control organ drives the pivoting of a first flap and the opening of a first aperture, a second actuation of the control organ drives the pivoting of a second flap and the opening of a second aperture, and a third actuation of the control organ drives the pivoting of the first and second flaps and the closing of the first and second apertures.

8. The timepiece according to claim 1, wherein the game is a baccarat game.

9. The timepiece according to claim 1, wherein the card game is a poker game.

10. The timepiece according to claim 9, wherein said timepiece comprises lower display discs and an additional disc at least partially overlapping one of the lower discs and provided with openings through which the overlapped lower disc(s) may be visible and the discs may appear in apertures associated with a player or a dealer and the apertures associated with the dealer may be closed using an opening and closing system actuated by a control organ.

11. The timepiece according to claim 10, wherein the display discs bear depictions of the 52 cards of a full deck of 52 cards.

12. The timepiece according to claim 10, wherein the apertures associated with a player include a hiding system.

13. The timepiece according to claim 1, wherein the system for rotating and randomly stopping the discs comprises:

a spring organ, a winding click arranged to wind the spring organ and release it abruptly, a transmission plate connected to the spring organ to receive the energy transmitted by the latter when it is released, said plate being kinematically connected with said display discs sequentially, and each display disc is stopped by the friction of a jumper, which also defines the stopped position of the disc.

14. The timepiece according to claim 13, wherein said transmission plate comprises a series of toothed sectors interrupted by non-toothed sectors, said toothed sectors and said non-toothed sectors being positioned so as to be engaged or not engaged, respectively, with wheels secured and coaxial to said discs, in a synchronized manner.

15. The timepiece according to claim 14, wherein the jumper acts directly on said wheel secured to the respective disc.

16. The timepiece according to claim 13, wherein the spring organ is a balance-spring, fixed at a first end on an arbor on which the transmission plate pivots and at a second end on an element secured to the transmission plate or on the transmission plate itself.

17. The timepiece according to claim 13, wherein the winding click is actuated manually.

18. The timepiece according to claim 1, wherein said timepiece includes a striking mechanism coupled to said mechanical card game.

19. The timepiece according to claim 18, wherein the striking mechanism includes a gong, a hammer actuated by a lift and positioned to strike the gong while emitting a sound, and in that said lift is kinematically connected to the control organs of the systems for opening and closing the apertures.

20. The timepiece according to claim 19, wherein a ring is rotatably mounted and includes a first tooth designed to cooperate with said lift, and other teeth designed to be pushed when said control organs are actuated.

* * * * *